US005996710A

United States Patent [19]

Jansson et al.

[11] Patent Number: 5,996,710

[45] Date of Patent: Dec. 7, 1999

[54] DRILLING DEVICE

[75] Inventors: Kjell Jansson, Sollentuna; Erik Odén, Stockholm, both of Sweden

[73] Assignee: Atlas Copco Craelius AB, Marsta, Sweden

[21] Appl. No.: 08/930,445

[22] PCT Filed: Mar. 22, 1996

[86] PCT No.: PCT/SE96/00364

§ 371 Date: Jan. 12, 1998

§ 102(e) Date: Jan. 12, 1998

[87] PCT Pub. No.: WO96/30627

PCT Pub. Date: Oct. 3, 1996

[30] Foreign Application Priority Data

Mar. 31, 1995 [SE] Sweden ..... 9501199

[51] Int. Cl.[6] ..... E21B 19/20

[52] U.S. Cl. ..... 175/52; 175/85; 175/113

[58] Field of Search ..... 175/24, 40, 52, 175/85, 113, 122

[56] References Cited

U.S. PATENT DOCUMENTS 4,042,123 8/1977 Sheldon et al. ..... 175/85 X
4,187,546 2/1980 Heffernan et al. ..... 175/85 X

FOREIGN PATENT DOCUMENTS 2154026 8/1985 United Kingdom .

*Primary Examiner*—Roger Schoeppel
*Attorney, Agent, or Firm*—Mark P. Stone

[57] ABSTRACT

A drilling device has a frame (1) with a feed device (2) for carrying a drilling device (3) movable to-and-fro for rotating a drill string (4). The drilling device includes a sensor (6) for sensing an end (7) of a drill string element (8) in the drill string (4), and a register for the position of the end (7) along the feed device (2) and for the displacement of the drilling device (3) along the feed device (2).

3 Claims, 1 Drawing Sheet

DRILLING DEVICE

BACKGROUND OF THE INVENTION

The present invention relates to a drilling device of the type used for drilling in rock or earth layers or similar. More specifically the invention relates to a drilling device which is suitable for drilling with long drill strings comprising a large number of drill string elements which may have somewhat different lengths.

In prior art drilling devices, e.g. for exploration drilling, of the kind which the present invention aims at improving it is important for achieving good efficiency in the handling of the drill string to have two operators, one who handles the drilling machine and one who handles the drill string elements. In exploration drilling this handling is very time-consuming since one takes up drill samples every third meter or so and the drill string comprises several hundred drill string elements.

SUMMARY OF THE INVENTION

The present invention which is defined in the subsequent claims aims at achieving a drilling device where drilling and handling of the drill string efficiently can be handled by one operator independent of variations in tube length drill string weight drilling direction and starting position. In particular, the invention makes it possible to automatically make and break joints between drill string elements having even surfaces and substantially constant diameters.

BRIEF DESCRIPTION OF THE DRAWINGS

An embodiment of the invention is described below with reference to the accompanying drawing in which.

DESCRIPTION OF THE BEST MODE FOR CARRYING OUT THE INVENTION

Figure 2:
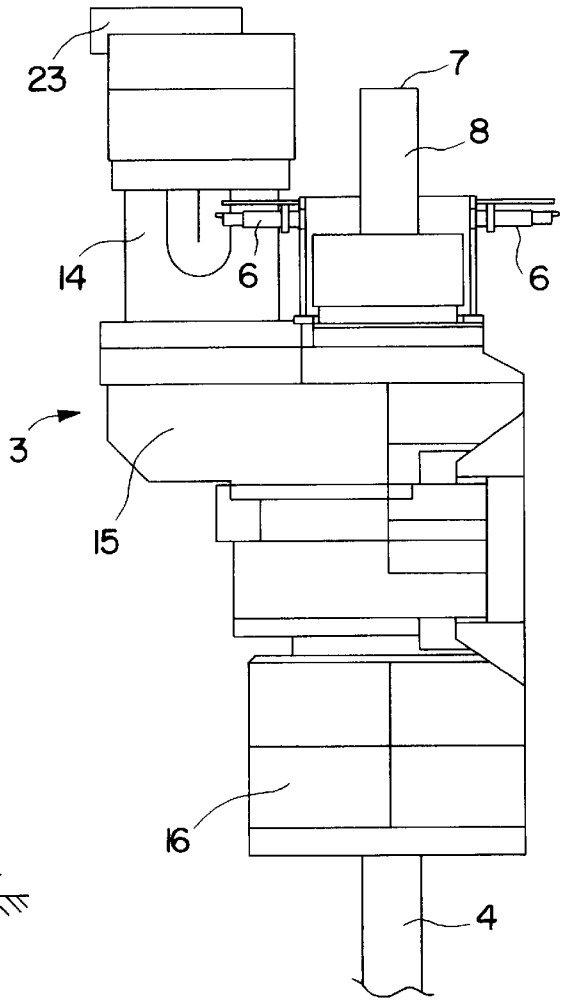
FIG. 2 shows a part of the drilling device in FIG. 1 on a larger scale.
Figure 1:
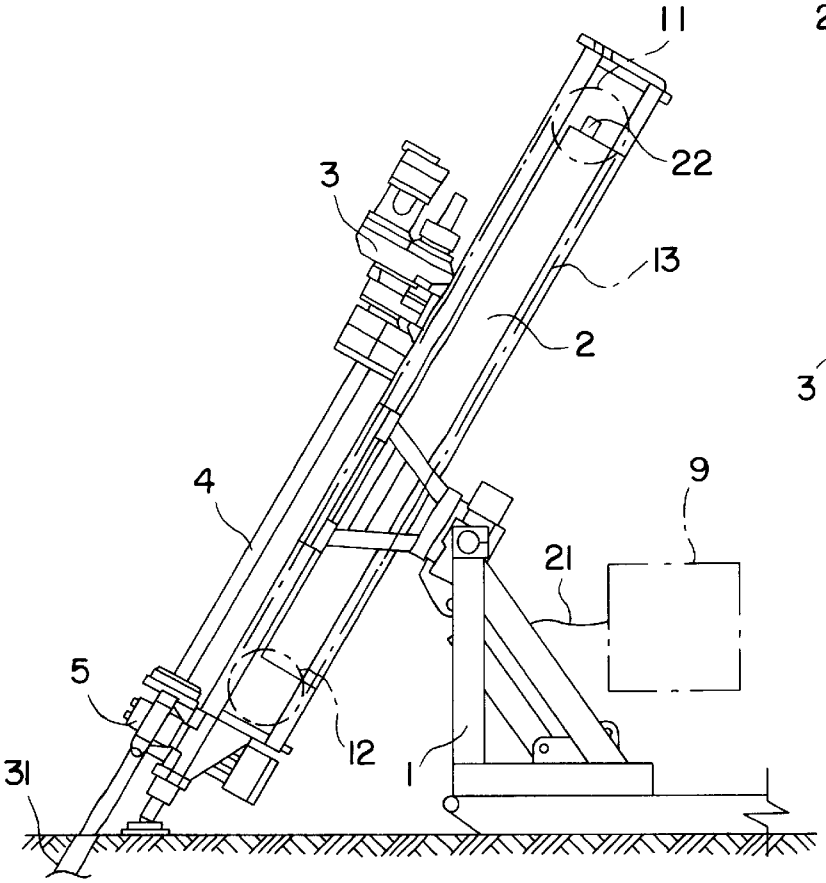
FIG. 1 shows a side view of a drilling device according to the invention.

The drilling device shown in the drawing comprises a frame 1 on which a feed device 2 is arranged. The frame can be in the form of a sleigh as shown in FIG. 1 or a vehicle or some other arrangement carrying the feed device in a stable manner. The feed device 2 comprises in the shown example two sprockets 11, 12 and a chain 13 which passes over the sprockets and is connected with a drilling device 3. The teed device can be made in in arbitrary wax which allows displacement of the drilling unit 3 to-and-fro along the feed device. The drilling device 3 comprises a rotation motor 14 which via a gear box 15 rotates a chuck 16. The drilling device has a through passage for a drill string 4.

The chuck 16 comprises gripping means which can be brought into contact the drill string for rotation of the drill string. The chuck is arranged for gripping or releasing the drill string 4 under fluid pressure control. A holder 5 for the drill string 4 is arranged at the lower and of the feed device 2. Cooperation between the chuck 16, the holder 5, the feed device 2 and the drilling device 3 can be as described in U.S. Pat. No. 3,613,804. The holder 5 comprises gripping means for gripping or releasing the drill string under fluid pressure control. One important aspect of the present invention is the possibility of automatically making or breaking the joints between two drill string elements 8. This is done through gripping the drill string 4 with both the chuck 16 and the holder 5 and rotating the chuck in either direction depending on what is desired. In this respect it is important that the drilling device is movable along the feed device to make it possible to apply torque to the drill string. With the present invention this can be obtained with drill string elements having an even surface and substantially constant outer diameter.

The drilling device 3 is provided with means 6 for the sensing of an end 7 of a drill string element 8 being a part of the drill string 4. In the shown example one uses an infra-red light source and a sensor for infra-red light. One can also use other means, e.g. mechanical sensing. The feed device 2 furthermore comprises a meter 22 for measuring the position of the drilling device 3 along the feed device. The drilling device 3 is provided with speed counter 23 for indication of the rotational speed of the drilling device and thus also indication if rotation exists or not. Signals from the different transmitters are fed via cables 21 to a means 9 for registering the position of the end 7 relative to the drilling device 3. This is done when the end 7 passes the infra-red light at 6. The means 9 for registering is also used for registering the displacement of the drilling device 3 along the feed device and for registering the rotation of the feed device. In the shown example the unit 9 comprises a computer for controlling the different functions during drilling, when adding drill string elements and when taking away drill string elements. This makes a high degree of automation of the drill string handling possible. Through sensing the end of a drill string element one can achieve automation of the handling of the drill string elements in the drilling device. This is achieved through adjusting the registering means 9 for each drill string element for variations in the position of the drill string element so that one all the time knows where the joint between two drill string elements is situated even if the drill string has a large number. e.g. 500 drill string elements. The difficulty in achieving an automatic withdrawal or insertion of a large number of connected drill string elements has been the addition of errors in the position of the end of the drill string elements. These errors depend on smaller variations in the lengths of the drill string elements or on that the drill string glides somewhat in the holder 5 or the chuck 16.

The drilling device shown in the drawing works in the following way when the drill string 4 is inserted in a bore hole 31. In the starting position the holder 5 is closed so that the part of the drill string 4 in the bore hole 31 is held by the holder. Furthermore a drill string element 8 has been screwed on by hand about one turn. The chuck 16 is open. In this position the automatic insertion is started, e.g. by means of a pedal. The drilling device 3 is fed upward along the feed device 2 to a predetermined position. The chuck 16 is closed. The chuck 16 is rotated so that the joint situated between the holder 5 and the chuck 16 is screwed together. The check that so has occurred is that the chuck has iotated a predetermined number of turns and that the rotational speed has decreased to zero. The holder 5 is opened and the drilling device 3 is fed downward so that the drill string 4 is fed into the bore hole 31. The holder 5 is closed and the chuck 16 opened. Then the drilling device 3 is fed upward until the upper end 7 of the drill string element 8 is sensed by the sensing means 6. Maybe one must grip several times with intermediate feeding in of the drill string if the drill string elements are longer than the feed length of the feed device 2. Then the drilling. Device 3 is fed downward a predetermined distance in order to have the end 7 of the drill string in a suitable position relative to the drilling device. The chuck 16 is closed, the holder 5 opened and the drilling device 3 is fed downward so that the drill string is fed into the bore hole 31. Then the holder 5 is closed and the chuck 16 opened. After that the operator adds a drill string element to the drill string and the above described cycle is repeated until the entire drill string has been fed into the drill hole. The computer in the registering means 9 keeps a track of how many drill string elements have been fed into the bore hole and where the joints are relative to the drilling device.

When the drill string has reached the hole bottom drilling starts. The operator sets the desired drilling parameters. The automatics in the registering, device 9 then controls the drilling process so that the set values are maintained. Through this automates the operator is relieved. Furthermore a substantially improved control precision is obtained than what is possible manually. Through this the wear of the drill bit is decreased substantially.

When drilling is interrupted, e.g. because the core barrel is full or because the drill bit need being replaced, the drill string should be fed out of the hole. When withdrawing the cycle is started, for instance with the above mentioned pedal. The process is the opposite to the one of insertion. The automatics keeps track of where the end of the drill string is positioned and the operator takes out the drill string elements instead of adding them.

We claim:

1. Drilling device comprising a frame (1), a feed device (2) on the frame for a drilling device (3) being movable to-and-fro along the feed device and comprising a chuck (16) for gripping or releasing a drill string (4) under fluid pressure control for rotation of the drill string (4), a holder (5) for the drill string (4) arranged on the feed device (2) for gripping or releasing the drill string (4) under fluid pressure control, characterized by means (6) for sensing an end (7) of a drill string element (8) forming part of the drill string (4), said drill string elements (8) having a substantially constant diameter along their length, and means (9) for registering the position of said end (7) along the feed device (2) relative to said drilling device (3), for positioning the end 7) on the drill string element (8) to a predetermined position alone the feed device (2).

2. Drilling device according to claim 1, characterized in that said means for sensing said end (7) comprises a light source (6), and a sensor for this light source.

3. Drilling device according to claim 2, characterized in that said light source (6) is for infra-red light.

* * * * *

UNITED STATES PATENT AND TRADEMARK OFFICE

CERTIFICATE OF CORRECTION

PATENT NO. : 5,996,710

DATED : December 7, 1999

INVENTOR(S) : Kjell Jansson & Erik Oden

It is certified that error appears in the above-identified patent and that said Letters Patent is hereby corrected as shown below:

Column 4, Line 15 (Claim 1, Line 14):

Delete "alone", and substitute - -along- -.

Signed and Sealed this

Twenty-third Day of May, 2000

*Attest:*

Q. TODD DICKINSON

*Attesting Officer*

*Director of Patents and Trademarks*